US009638189B2

(12) United States Patent
Miyajima et al.

(10) Patent No.: US 9,638,189 B2
(45) Date of Patent: May 2, 2017

(54) OIL PUMP STRUCTURE

(71) Applicant: YAMADA MANUFACTURING CO., LTD., Kiryu-shi (JP)

(72) Inventors: Junichi Miyajima, Kiryu (JP); Takatoshi Watanabe, Kiryu (JP); Masato Izutsu, Kiryu (JP); Masaki Ogawara, Kiryu (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 47 days.

(21) Appl. No.: 14/852,531

(22) Filed: Sep. 12, 2015

(65) Prior Publication Data

US 2016/0090983 A1 Mar. 31, 2016

(30) Foreign Application Priority Data

Sep. 30, 2014 (JP) ..... 2014-201846

(51) Int. Cl.
*F01C 20/18* (2006.01)
*F04C 14/22* (2006.01)
*F04C 2/10* (2006.01)

(52) U.S. Cl.
CPC ..... *F04C 14/226* (2013.01); *F04C 2/102* (2013.01)

(58) Field of Classification Search
CPC ..... F04C 14/226; F04C 2/102
See application file for complete search history.

(56) References Cited

U.S. PATENT DOCUMENTS 6,168,391 B1 * 1/2001 Ono ..... F04C 2/102 417/310
7,588,011 B2 * 9/2009 Ono ..... F04C 2/102 123/196 R
8,690,544 B2 * 4/2014 Ono ..... F04C 2/102 417/213

(Continued)

FOREIGN PATENT DOCUMENTS

JP 2012-145095 A 8/2012

*Primary Examiner* — Jesse Bogue
(74) *Attorney, Agent, or Firm* — McGinn IP Law Group, PLLC

(57) ABSTRACT

An oil pump structure including: an oil pump having a first hydraulic control chamber and a second hydraulic control chamber; a hydraulic control valve having a valve operating oil passage, a first inflow passage, a second inflow passage, a first outflow passage, a second outflow passage and a drain flow passage; and an oil circuit, wherein the hydraulic control valve is connected to a branching flow passage of the oil circuit; a spool valve body of the hydraulic control valve has a front valve section, a rear valve section and an intermediate valve section, which are formed perpendicularly to the axial direction of a connecting shaft; an axial-direction dimension of the intermediate valve section is larger than an axial-direction dimension of the second outflow passage; the second outflow passage and the drain flow passage are both accommodated temporarily between the intermediate valve section and the front valve section due to movement of the spool valve body; and in the hydraulic control valve, a control hydraulic pressure is applied at all times to the first hydraulic control chamber, and the control hydraulic pressure is increased and decreased in the second hydraulic control chamber.

5 Claims, 7 Drawing Sheets

(56) References Cited

U.S. PATENT DOCUMENTS

| | | | | |
|---|---|---|---|---|
| 8,807,964 | B2 * | 8/2014 | Kwon | F04C 14/26<br>137/118.06 |
| 9,032,929 | B2 * | 5/2015 | Inoue | F01M 1/16<br>123/196 R |
| 2005/0098385 | A1 * | 5/2005 | Ono | F04C 14/065<br>184/6.5 |
| 2014/0119969 | A1 * | 5/2014 | Iijima | F04C 2/344<br>418/30 |
| 2014/0154119 | A1 * | 6/2014 | Izutsu | F04C 2/10<br>418/19 |
| 2015/0252803 | A1 * | 9/2015 | Ohnishi | F01M 1/02<br>418/26 |
| 2016/0108781 | A1 * | 4/2016 | Miyajima | F01M 1/02<br>137/565.11 |

* cited by examiner

Fig.2A
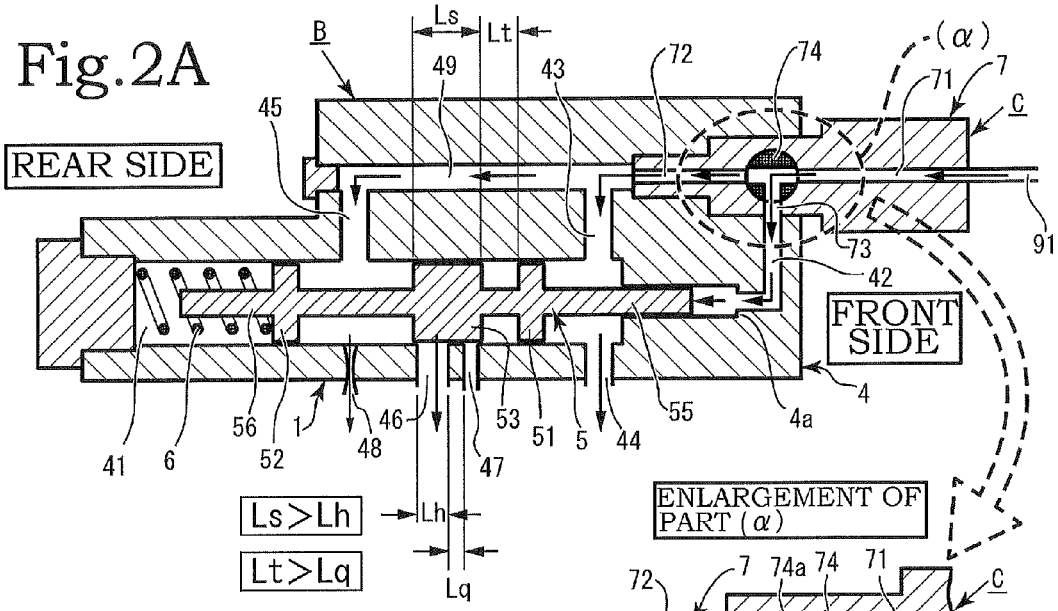
Fig.2B
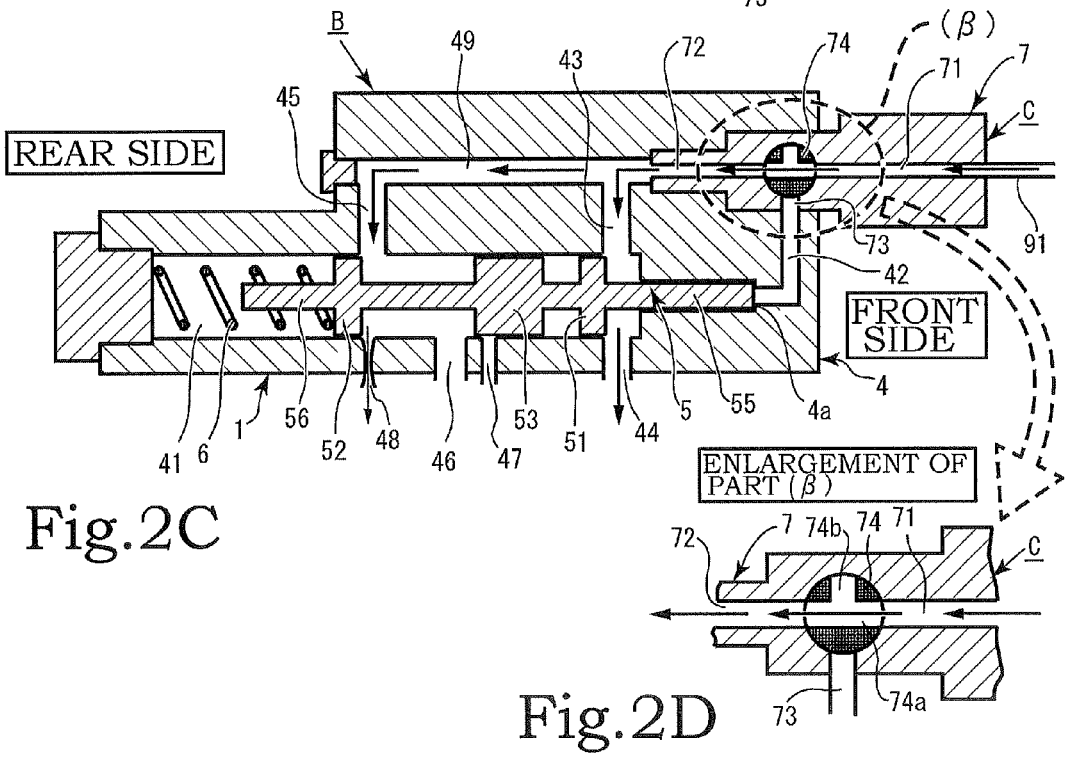
Fig.2C
Fig.2D

Fig.4A
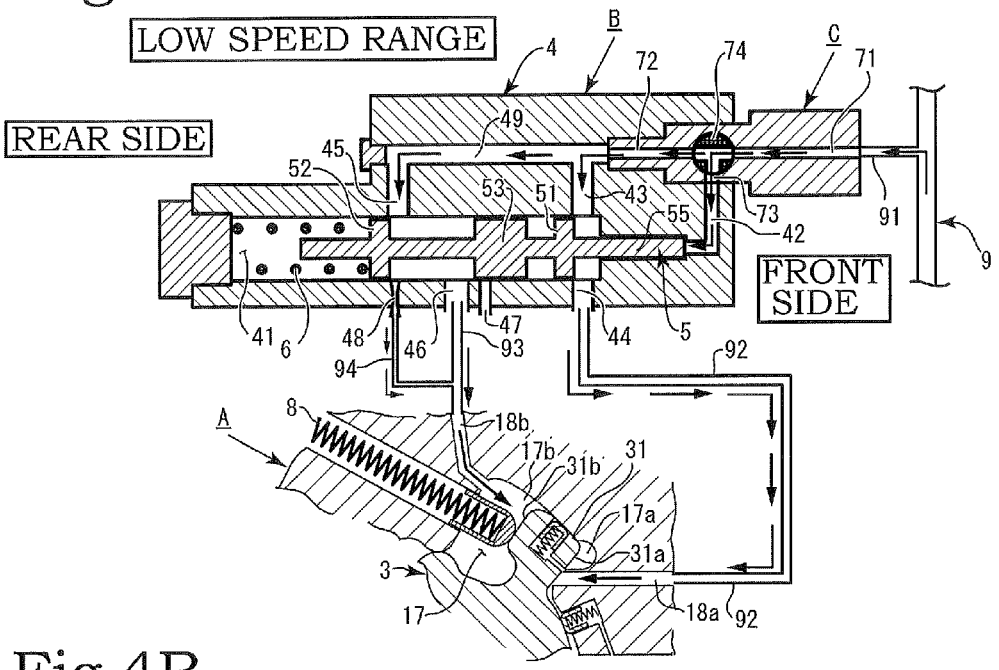
Fig.4B
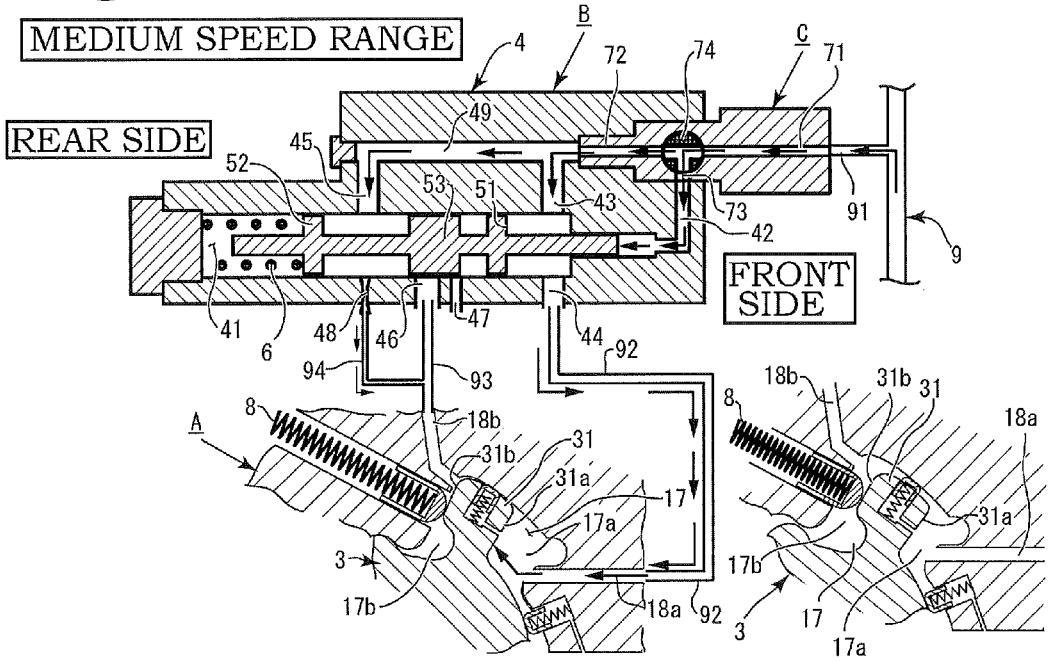
Fig.4C

Fig.5A
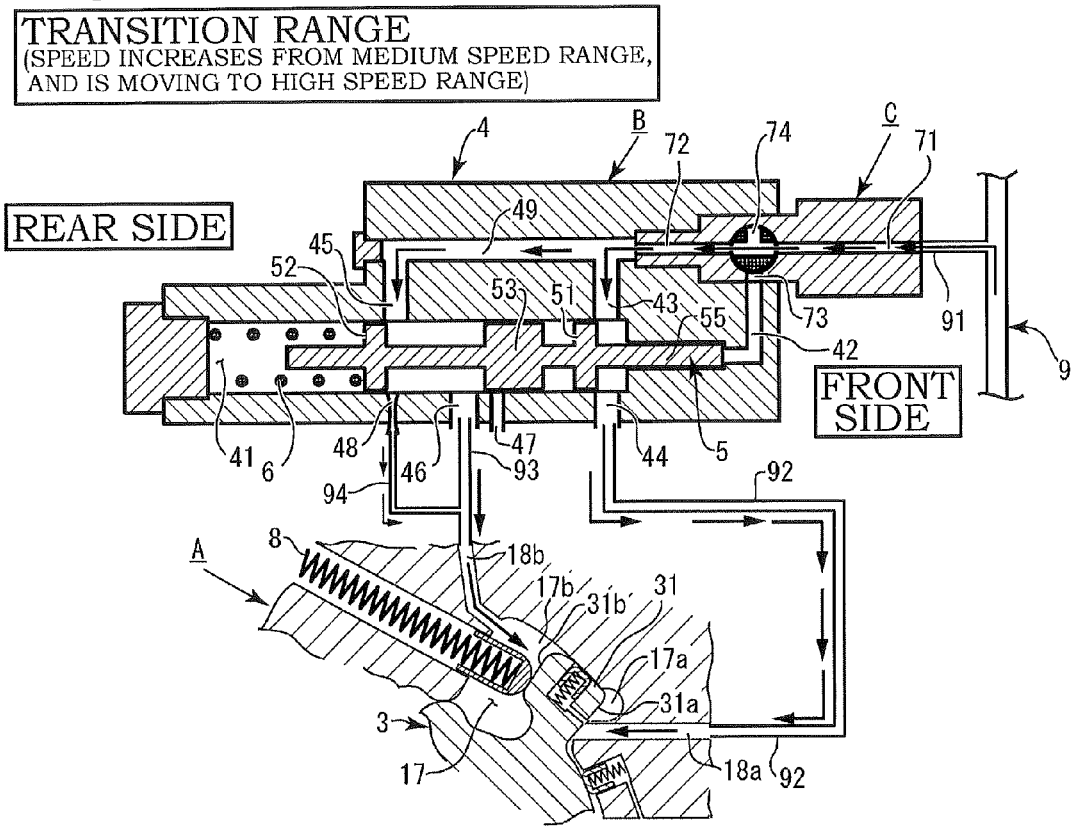
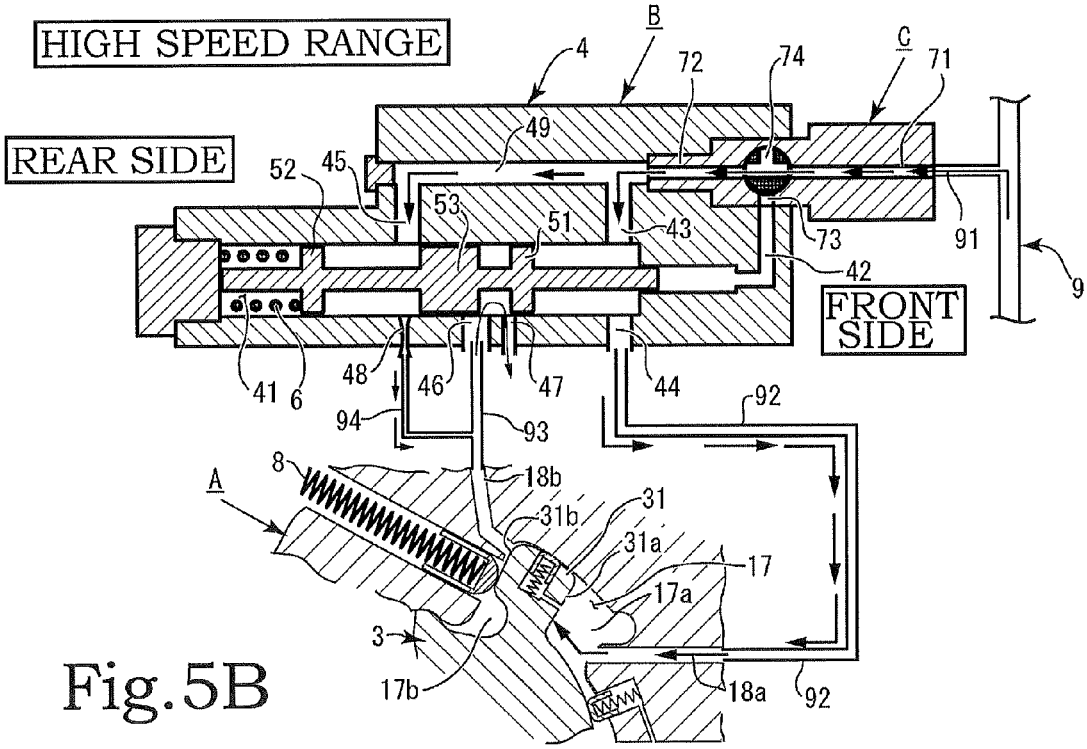
Fig.5B

OIL PUMP STRUCTURE

BACKGROUND OF THE INVENTION

1. Field of the Invention

The present invention relates to an oil pump structure for stabilizing discharge pressure of an oil pump of a variable-capacity type, which is used in a vehicle engine, or the like.

2. Description of the Related Art

As oil pumps for automobile engines, there are variable-capacity oil pumps in which the discharge amount can be increased and decreased. Among these, there are pumps wherein the operation of varying the discharge amount is performed by hydraulic means. A specific example of a pump of this kind is disclosed in Japanese Patent Application Publication No. 2012-145095. In Japanese Patent Application Publication No. 2012-145095, as a means for varying the discharge amount, an adjustment ring (14) is moved, thereby causing the pump capacity to increase or decrease. A hydraulic valve is used as means for moving the adjustment ring (14).

SUMMARY OF THE INVENTION

In Japanese Patent Application Publication No. 2012-145095, a supply oil passage (31) for supplying oil from a discharge port (3) to an engine (E) is formed, and a control valve (V) is provided at a position where the oil pressure from this supply oil path (31) acts. A first control oil passage (C1) for carrying out operations such as applying a control pressure to a pressure receiving section (21), or releasing the control pressure, is disposed between the control valve (V) and the pressure receiving section (21).

A second oil passage (C2) for applying oil pressure is provided in an intermediate portion of the valve body (35) from the supply oil passage (31). A discharge oil passage (33) for sending oil discharged from the control valve (V) to a low-pressure space (LP) is also formed. In the configuration described above, as indicated in paragraph [0066], when the engine speed is lower than N3-N4, the second control oil passage (C2) is shut off by the control valve (V) at the timing where the engine speed exceeds N3 (where the oil pressure exceeds a third control value), as shown in FIG. 4.

Simultaneously with this, the first control oil passage (C1) is connected to the discharge oil passage (33) by the control valve (V), and the control pressure acting on the pressure receiving section (21) declines significantly. In this way, according to the description in paragraph [0066], the timing at which the control pressure acting on the pressure receiving section (21) is shut off and the timing at which the control pressure that has been acting on the pressure receiving section (21) is allowed to escape from the discharge oil passage (33) are simultaneous.

Comparing FIG. 3 and FIG. 4 of Japanese Patent Application Publication No. 2012-145095, there is a concern that the following phenomenon may occur. When a control pressure is applied to the pressure receiving section (21), the pump capacity decreases and the oil pressure also falls. Furthermore, when the control pressure is not applied to the pressure receiving section (21), the pump capacity increases and the oil pressure also increases. Moreover, the oil pressure repeatedly increases and decreases due to pulsations, rather than remaining uniform.

When the oil pressure is near the third control value, the oil pressure repeatedly increases and decreases with a short cycle, and therefore an operation of applying, and not applying, a control pressure to the pressure receiving section (21) is repeated with a short cycle. If an operation of applying and not applying a control pressure to the pressure receiving section (21) is repeated with a short cycle, then the pump capacity increases and decreases with a short cycle. Therefore, the oil pressure repeatedly increases and decreases with a short cycle. This means that the pulsations in the oil pressure increase, and if the pulsations in the oil pressure increase, then noise and vibrations occur, causing discomfort to the driver, as well as reducing the durability of the apparatus.

Moreover, although a specific example is not given, there is a risk that the abovementioned phenomenon may also occur similarly in a variable-capacity oil pump of a "vane" type. Therefore, the object of the present invention (the technical problem to be solved) is to suppress sudden changes in oil pressure during variable operation in an oil pump of a type in which the discharge amount can be varied by hydraulic control, thereby preventing vibrations, pulsations, shock sounds, noise, and the like.

Therefore, as a result of thorough repeated research aimed at resolving the abovementioned problem, the present inventors resolved the abovementioned problem by forming a first embodiment of the present invention as an oil pump structure, including: an oil pump which has a first hydraulic control chamber and a second hydraulic control chamber for performing an operation of varying a discharge amount, and in which an operation for varying the capacity is performed by applying a control hydraulic pressure to the first hydraulic control chamber and the second hydraulic control chamber; a hydraulic control valve which has a valve operating oil passage, a first inflow passage and a second inflow passage, by which oil discharged from the oil pump flows in, a first outflow passage by which oil is sent to the first hydraulic control chamber, a second outflow passage by which oil is sent to the second hydraulic control chamber, and a drain flow passage by which oil can be discharged externally; and an oil circuit in which oil is circulated by the oil pump, wherein the hydraulic control valve is connected to a branching flow passage of the oil circuit; a spool valve body which slides inside the hydraulic control valve is constituted by a connecting shaft, a front valve section, a rear valve section, and an intermediate valve section positioned between the front valve section and the rear valve section, with the front valve section, the rear valve section, and the intermediate valve section being formed perpendicularly to an axial direction of the connecting shaft; an axial-direction dimension of the intermediate valve section is larger than an axial-direction dimension of the second outflow passage; the second outflow passage and the drain flow passage are both temporarily accommodated between the intermediate valve section and the front valve section due to movement of the spool valve body; and a control hydraulic pressure is applied at all times to the first hydraulic control chamber, and the control hydraulic pressure is increased or decreased in the second hydraulic control chamber, by the hydraulic control valve.

The abovementioned problem was resolved by forming a second embodiment of the present invention as the oil pump structure according to the first embodiment, wherein an orifice which communicates at all times with the second hydraulic control chamber is provided in the hydraulic control valve. The abovementioned problem was resolved by forming a third embodiment of the present invention as the oil pump structure according to the first or second embodiment, provided with an operating valve which switches between communication and shut-off of the valve operating oil passage. The abovementioned problem was resolved by forming a fourth embodiment of the present invention as the oil pump structure according to the third embodiment, wherein the operating valve is a solenoid valve.

The present invention comprises: an oil pump in which a capacity variation operation is carried out by applying a control hydraulic pressure to the first hydraulic control chamber and the second hydraulic control chamber; a hydraulic control valve having a valve operating oil passage, a first inflow passage and a second inflow passage by which oil discharged from the oil pump flows in, a first outflow passage by which oil is sent to the first hydraulic control chamber, and a second outflow passage by which oil is sent to the second hydraulic control chamber; and a solenoid valve which switches the valve operating oil passage and the interior of a spool valve body passage between a communicated and shut-off state. By means of the hydraulic control valve, a control hydraulic pressure is applied at all times to the first hydraulic control chamber, and the control hydraulic pressure is increased and decreased in the second hydraulic control chamber, whereby it is possible to reduce noise and/or vibration in the event of variation in the capacity of the oil pump.

Furthermore, the axial-direction dimension of the intermediate valve section in the spool valve body in the hydraulic control valve is larger than the axial-direction dimension of the second outflow passage. Therefore, the intermediate valve section can completely close off the second outflow passage, and even if the spool valve body moves to the rear side, it is possible to have a time band (time period) in which the oil is shut inside the second hydraulic control chamber. In this state, since the oil is a non-compressible fluid, then the oil inside the second hydraulic control chamber acts as a damper, and slight vibrations in the operation of the oil pump can be suppressed, and vibrations and/or noise can be reduced. Even if the intermediate valve section moves to some extent, it is still possible to keep the second outflow passage in a closed state, and hunting can be suppressed by the damping effect of the oil.

Furthermore, a drain flow passage is provided in the hydraulic control valve and the second outflow passage and the drain flow passage are disposed as a position so as to be accommodated temporarily between the intermediate valve section and the front valve section due to the movement of the spool valve body. In other words, the second outflow passage and the drain flow passage are communicated, and the second outflow passage and the second inflow passage are shut off. Consequently, it is possible to discharge oil inside the second hydraulic control chamber, readily, and the discharge amount of the oil pump can be changed smoothly.

BRIEF DESCRIPTION OF THE DRAWINGS

FIG. 2A is a cross-sectional diagram showing the operation of the hydraulic control valve and the solenoid valve, FIG. 2B is an enlarged diagram of part (α) in FIG. 2A, FIG. 2C is a cross-sectional diagram showing the operation of the hydraulic control valve and the solenoid valve, and FIG. 2D is an enlarged diagram of part (β) in FIG. 2C;

FIG. 4A is a principal schematic drawing showing the operation of the present invention in a low speed range of the engine, FIG. 4B is a principal schematic drawing showing the operation of the present invention in a medium speed range of the engine; and FIG. 4C is a principal schematic drawing in which the operating protrusion partitions the operating chamber into two parts in the present invention.

FIG. 5A is a principal schematic drawing showing the operation of the present invention in a transition range where the engine speed increases from the medium speed range and moves towards a high speed range, and FIG. 5B is a principal schematic drawing showing the operation of the present invention in a high speed range of the engine;

DESCRIPTION OF THE PREFERRED EMBODIMENTS

Figure 1:
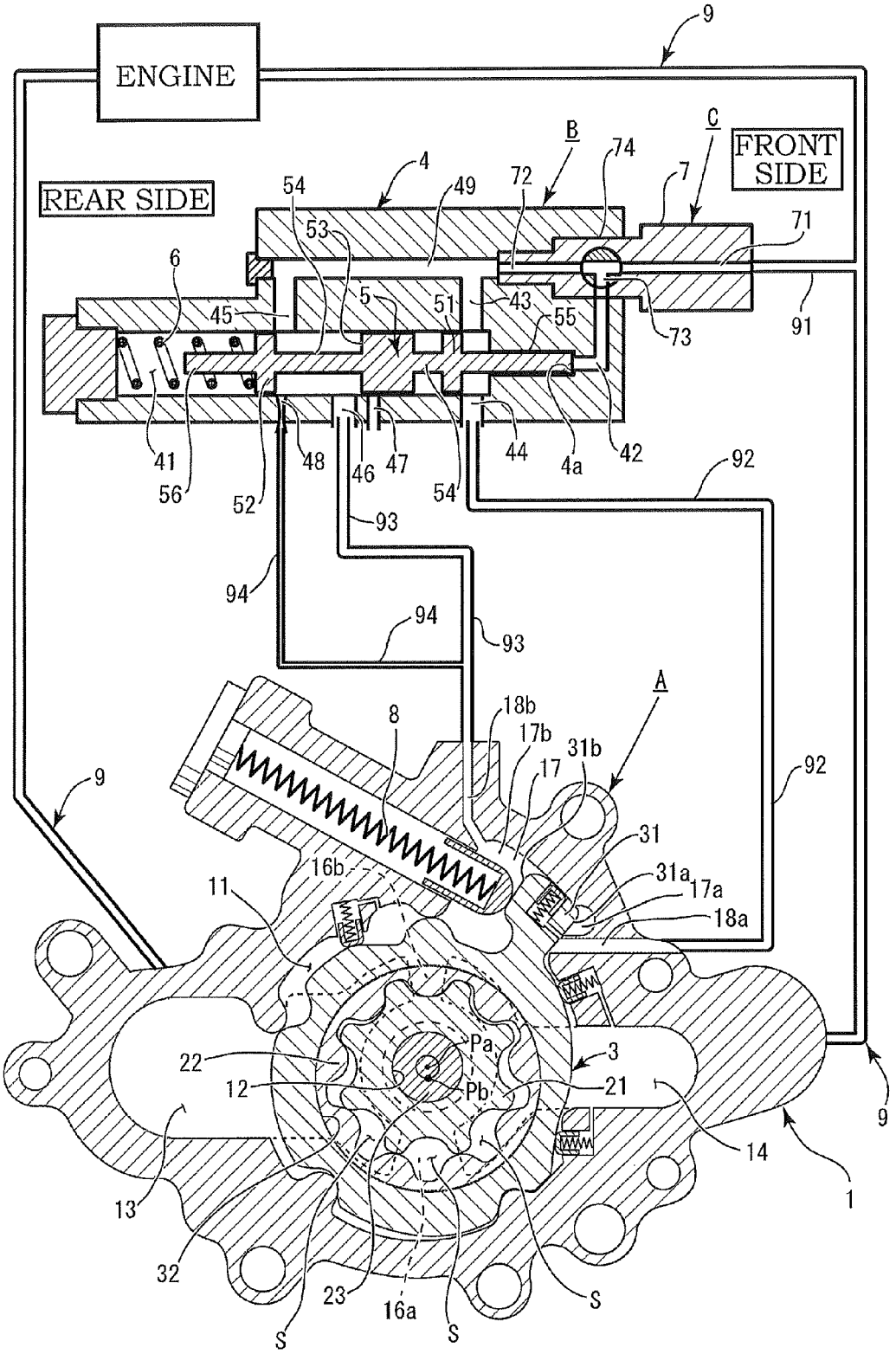
FIG. 1 is a schematic drawing showing a configuration of an oil pump, a hydraulic control valve, a solenoid valve and an oil circuit according to the present invention.

An embodiment of the present invention is described below on the basis of the drawings. As shown in FIG. 1, the present invention is configured principally by an oil pump A, a hydraulic control valve B and an operating valve C. The oil pump A mainly circulates oil to an automobile engine, and is of a variable-capacity type in which the discharge amount can be varied disproportionately with respect to the engine speed. The operation of varying the discharge amount of the oil pump A is carried out by the hydraulic control valve B and the operating valve C which are provided in an oil circuit 9 that circulates oil from the oil pump A to the engine.

There exist various structures for the oil pump A, but in the present invention, an internal gear type of pump is described (see FIG. 1). The oil pump A is configured by a pump housing 1, an inner rotor 21, an outer rotor 22 and an outer ring 3. A rotor chamber 11 is formed in the pump housing 1. A shaft hole 12 into which a drive shaft 23 for driving the pump is installed is formed in the bottom surface portion of the rotor chamber 11, and an inlet port 13 and a discharge port 14 are formed about the periphery of the shaft hole 12.

A first sealing land 16*a* is present between the final end portion of the inlet port 13 and the start end portion of the discharge port 14, and a second sealing land 16*b* is present between the final end portion of the discharge port 14 and the start end portion of the inlet port 13. An operating chamber 17 that is connected to the rotor chamber 11 is formed in the pump housing 1 and an operating protrusion 31 of the outer ring 3, which is described below, is disposed therein. The inner rotor 21, the outer rotor 22 and the outer ring 3 are installed inside the rotor chamber 11.

The inner rotor 21 is a gear wheel having a trochoid shape or substantial trochoid shape, on which a plurality of outer teeth are formed. Furthermore, a boss hole for the drive shaft is formed in a central position thereof in the radial direction, and the drive shaft 23 is passed through and fixed in the boss hole. The outer rotor 22 is formed in a ring shape and has a plurality of inner teeth formed in the inner circumferential side thereof.

The number of outer teeth on the inner rotor 21 is one fewer than the number of inner teeth on the outer rotor 22.

A plurality of cells (spaces between teeth) S are formed by the outer teeth on the inner rotor 21 and the inner teeth on the outer rotor 22.

The distance between the center of rotation Pa of the inner rotor 21 and the center of rotation Pb of the outer rotor 22 forms an amount of eccentricity, and a trajectory circle is created which is centered on the center of rotation Pa of the inner rotor 21 and has a radius equal to the amount of eccentricity. By the operation of the outer ring 3, the center of rotation Pb of the outer rotor 22 moves along a fan-shaped arc which is one portion of the trajectory circle, from an initial position state to a final position state.

The outer ring 3 is formed in a substantially circular ring-shape, and has an operating protrusion 31 formed in a protruding shape in the outward radial direction from a prescribed location on the outer circumferential surface thereof. Furthermore, a gripping inner circumference section 32, which is a perfectly circular through hole, is formed in the inner side of the outer ring 3. The outer ring 3 performs a swinging action inside the rotor chamber 11 due to an operating means (described below), via the operating protrusion 31. The operating protrusion 31 is disposed in the operating chamber 17 and is caused to swing inside the operating chamber 17.

The gripping inner circumference section 32 is formed as a circular inner wall surface, and the inner diameter of the gripping inner circumference section 32 is substantially the same as the outer diameter of the outer rotor 22, and more specifically, the inner diameter of the gripping inner circumference section 32 is slightly greater than the outer diameter of the outer rotor 22, and the outer rotor 22 is inserted with a clearance between the gripping inner circumference section 32 and the outer rotor 22, so as to be smoothly rotatable.

The center of the diameter of the gripping inner circumference section 32 of the outer ring 3 coincides in position with the center of rotation Pb of the outer rotor 22 when inserted into the gripping inner circumference section 32. The outer ring 3 is installed inside the rotor chamber 11 of the pump housing 1, and is configured so as to be able to swing inside the rotor chamber 11. The outer ring 3 performs a swinging action due to the hydraulic control valve B and the operating valve C which are described below.

A first pressure receiving surface 31*a* is formed on the operating protrusion 31 in one direction of the swinging action and a second pressure receiving surface 31*b* is formed thereon in the other direction of the swinging action (see FIG. 1, FIG. 4A and FIG. 5A). The operating protrusion 31 is configured so as to partition the operating chamber 17 into two parts, when disposed inside the operating chamber 17. Inside the operating chamber 17, the hydraulic chamber on the side faced by the first pressure receiving surface 31*a* is called a first hydraulic control chamber 17*a* and the hydraulic chamber on the side faced by the second pressure receiving surface 31*b* is called a second hydraulic control chamber 17*b*.

Furthermore, an impelling member 8 is provided in the operating chamber 17 (see FIG. 1). The impelling member 8 elastically presses the second pressure receiving surface 31*b* of the outer ring 3 and keeps the outer ring 3 and the outer rotor 22 in the initial position at all times. Furthermore, a first oil passage 18*a* which is communicated with the first hydraulic control chamber 17*a*, and a second oil passage 18*b* which is communicated with the second hydraulic control chamber 17*b*, are formed from the operating chamber 17.

The hydraulic control valve B is configured from a valve housing 4, a spool valve body 5 and an elastic member 6. The hydraulic control valve B may be incorporated into and integrated with the pump housing 1 as a portion of the pump housing 1. Alternatively, the pump housing 1 and the valve housing 4 may be respectively independent members.

A valve body passage 41 is provided inside the valve housing 4 (see FIG. 1, FIG. 2A-2D, etc.). A valve operating oil passage 42 is formed in one end of the valve body passage 41 in the axial direction. Here, the side of the valve body passage 41 which is communicated with the valve operating oil passage 42 in the axial direction is called the front side of the valve body passage 41, and the side thereof opposite to the valve operating oil passage 42 is called the rear side of the valve body passage 41.

The spool valve body 5 is disposed in the valve body passage 41, and the spool valve body 5 performs a reciprocal movement between the front side and the rear side, along the axial direction of the valve body passage 41. The valve operating oil passage 42 is communicated with the downstream side of the discharge port 14 side of the oil pump A, via an operating valve C. The spool valve body 5 moves reciprocally between the front side and the rear side of the valve body passage 41.

A first inflow passage 43, a first outflow passage 44, a second inflow passage 45, a second outflow passage 46, a drain flow passage 47 and an orifice 48 are formed in the valve housing 4 and the valve body passage 41 (see FIG. 1, FIG. 2). Furthermore, the first inflow passage 43, the first outflow passage 44, the drain flow passage 47, the second outflow passage 46, the second inflow passage 45 and the orifice 48 are formed in this sequence from the front side to the rear side of the valve body passage 41 (see FIG. 1 to FIG. 3D, etc.).

The first inflow passage 43 and the second inflow passage communicate with a branching flow passage 91 to the downstream side of the oil circuit 9 which connects the discharge port 14 side of the oil pump A with the engine. The first inflow passage 43 and the second inflow passage 45 respectively branch inside the valve housing 4 from a shared oil passage 49 in which the operating valve C (described below) is incorporated (see FIGS. 2A, 2C).

Oil discharged from the oil pump A can flow into the valve body passage 41 at all times. The first outflow passage is communicated with the first hydraulic control chamber 17*a* of the oil pump A via a first communicating passage 92. The second outflow passage 46 is communicated with the second hydraulic control chamber 17*b* of the operating chamber 17 of the oil pump A via a second communicating passage 93 (see FIG. 1). Furthermore, the orifice 48, which has the function of an oil aperture having restricted cross-sectional area, is communicated with the second hydraulic control chamber 17*b* via a third communicating passage 94. Furthermore, the third communicating passage 94 may be configured so as to merge with the second communicating passage 93 (FIG. 1).

The drain flow passage 47 is communicated with the outside of the valve housing 4 and serves to externally discharge oil. The oil that has been discharged externally is held in an oil pan, or the like, and is returned again to the inlet port 13 side of the oil pump A. The orifice 48 is communicated with the second hydraulic control chamber 17*b* of the oil pump A.

In the spool valve body 5, a front valve section 51, a rear valve section 52 and an intermediate valve section 53 are connected by a connecting shaft 54 at a prescribed interval apart (see FIG. 1, FIG. 2A-2D). Moreover, a pressure receiving shaft 55 is formed to the front side of the front valve section 51 in the axial direction. Moreover, a spring supporting axle 56 is formed on the rear side of the rear valve section 52 in the axial direction. The front valve section 51, the rear valve section 52 and the intermediate valve section 53 have the same diameter, which is substantially equal to the inner diameter of the valve body passage 41, and hence a highly precise fitting structure is obtained.

The pressure receiving shaft 55 is inserted slidably inside the valve operating oil passage 42. When the pressure receiving shaft 55 receives the hydraulic pressure inside the valve operating oil passage 42 and slides, the spool valve body 5 slides along the valve body passage 41. The elastic member 6 is accommodated to the rear side of the valve body passage 41, and the spool valve body 5 is impelled elastically to the front side of the valve body passage 41. In this case, when the pressure receiving shaft 55 of the spool valve body 5 is not receiving hydraulic pressure from the valve operating oil passage 42, then the spool valve body 5 is positioned on the front side of the valve body passage 41. This state is called the initial position state of the spool valve body 5.

When the spool valve body 5 is in the initial position state, or in any other position, the front valve section 51 never closes the first inflow passage 43 and the first outflow passage 44 (see FIG. 4A-4C, FIG. 5A-5B). In other words, provided that the operating valve C described below is communicated, the first inflow passage 43 and the first outflow passage 44 are always open, and oil flows into the valve body passage 41 from the first inflow passage 43 at all times, and oil flows out from the first outflow passage 44 at all times, whereby a hydraulic pressure can be applied to the first hydraulic control chamber 17*a* of the oil pump A.

The spool valve body 5 is provided with restricting means 4*a* in order to restrict the sliding range so that the first inflow passage 43 and the first outflow passage 44 cannot be closed. More specifically, a step difference section is provided in the valve operating oil passage 42 and the range of sliding of the pressure receiving shaft 55 of the spool valve body 5 is thereby restricted. Furthermore, a step difference section is formed at an appropriate position on the front side of the valve body passage 41, as the restricting means 4*a*.

The second inflow passage 45 and the second outflow passage 46 have a structure which is opened and closed by the intermediate valve section 53 of the spool valve body 5. Therefore, the flow of oil from the second inflow passage 45 to the second outflow passage 46 is set to either a communicating or non-communicating (shut-off) state, depending on the position of the spool valve body 5 inside the valve body passage 41. More specifically, the flow of oil from the second outflow passage 46 to the second hydraulic control chamber 17*b* of the oil pump A can be activated and halted (see FIG. 4A-4C, FIG. 5A-5B).

Next, the sizes and the relative positional configuration of the intermediate valve section 53, the second outflow passage 46 and the drain flow passage 47 of the spool valve body 5 are indicated below.

Figure 3A:
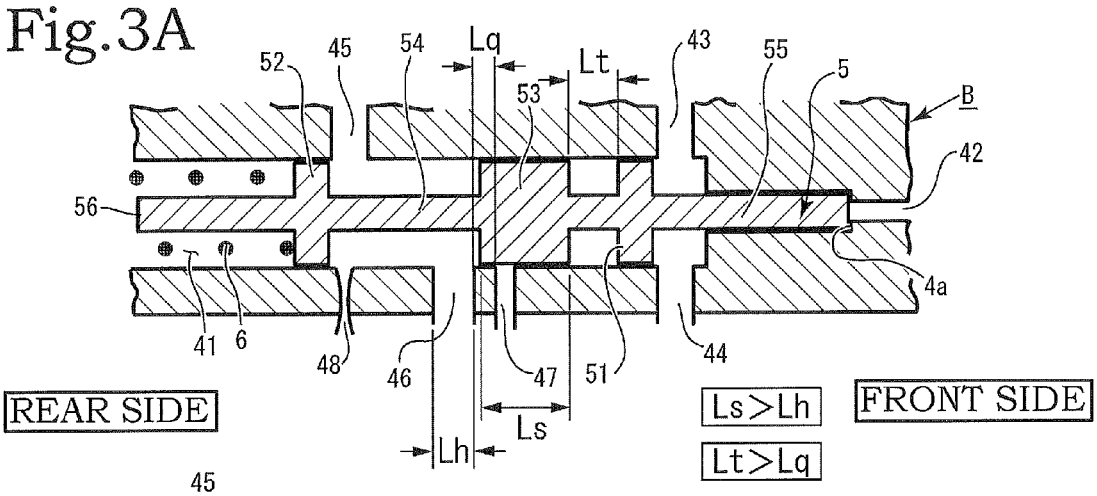
FIG. 3A is a principal enlarged diagram showing the configuration of a first embodiment of a hydraulic control valve.
Figure 3B:
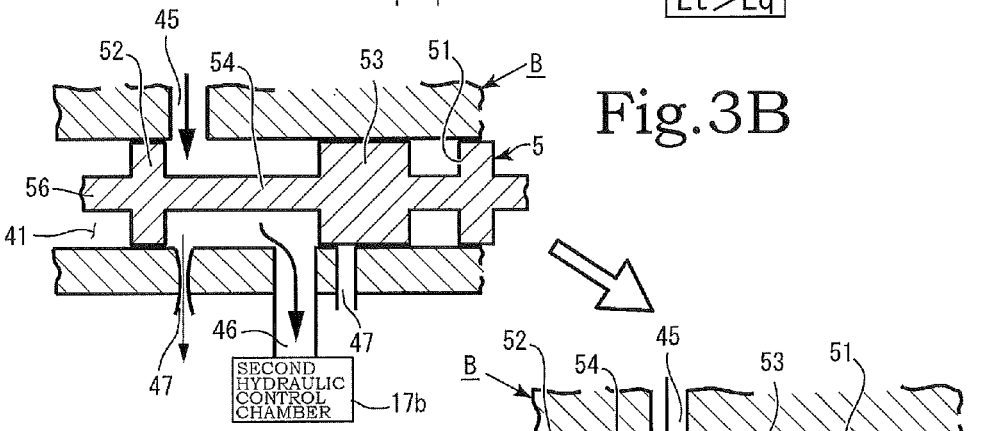
FIGS. 3B to 3D are principal enlarged diagrams showing the operation in the configuration of the first embodiment.
Figure 3C:
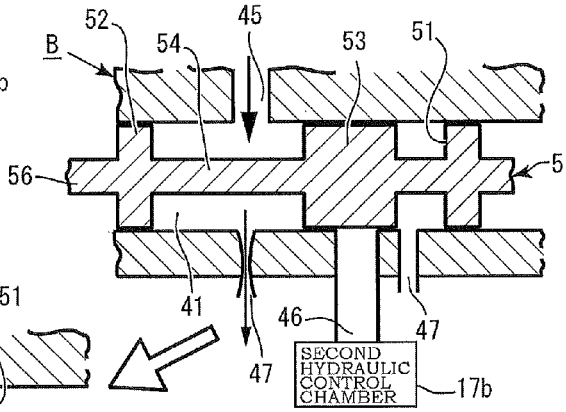

The length Ls of the intermediate valve section 53 of the spool valve body 5 in the axial direction is set to be greater than the length Lh of the second outflow passage 46 in the axial direction (see FIG. 2A, FIG. 3A).

In other words,

Ls>Lh

The axial-direction dimension of the intermediate valve section 53 of the spool valve body 5 inside the hydraulic control valve B is greater than the axial-direction dimension Lh of the second outflow passage 46. Therefore, the intermediate valve section 53 can completely close off the second outflow passage 46.

Thereupon, even if the intermediate valve section 53 is moved to some extent, the second outflow passage 46 is maintained in a closed state, and the occurrence of "hunting" can be suppressed by the damping effect of the oil. From the foregoing, it is possible to ensure that there is always a time band (time period) during which the oil is shut inside the second hydraulic control chamber 17*b* (see FIG. 3C).

In this state, since the oil is a non-compressible fluid, the oil in the second hydraulic control chamber 17*b* acts as a damper. Therefore, it is possible to suppress slight vibrations in the operation of the oil pump, and vibrations and/or noise can be reduced. Even if the intermediate valve section 53 moves to some extent, the second outflow passage 46 is maintained in a closed state, and "hunting" can be suppressed by the damping effect of the oil.

Furthermore, the second outflow passage 46 and the drain flow passage 47 are configured so as to be accommodated temporarily between the intermediate valve section 53 and the front valve section 51 by the movement in the axial direction of the spool valve body 5 inside the spool valve body passage 41. Here, the configuration in which the second outflow passage 46 and the drain flow passage 47 are accommodated between the intermediate valve section 53 and the front valve section 51 is the temporary existence of a state where, during the course of the rearward movement of the spool valve body 5 along the spool valve body passage 41, the second outflow passage 46 and the drain flow passage 47 are both positioned between the intermediate valve section 53 and the front valve section 51 and assume a mutually communicating state (see FIG. 3D). Furthermore, the accommodated configuration may be one where respective portions of both the second outflow passage and the drain flow passage 57 are situated between the intermediate valve section 53 and the front valve section 51 (see FIG. 3D).

Figure 3D:
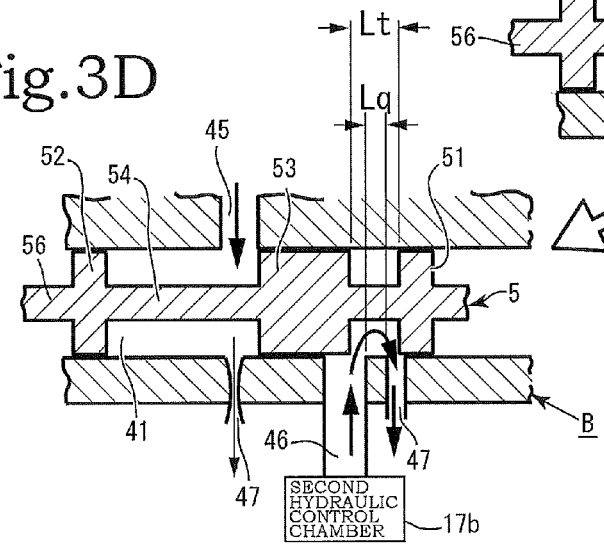

In other words, taking Lt to be the interval dimension in the axial direction of the gap formed between the intermediate valve section 53 and the front valve section 51 of the spool valve body 5, and taking Lq to be the smallest gap dimension in the axial direction between the second outflow passage 46 and the drain flow passage 47 of the valve housing 4, then Lt>Lq (see FIGS. 3A, 3D).

By means of a configuration of this kind, during the course of movement of the spool valve body 5, the second outflow passage 46 and the drain flow passage 47 can become communicated between the intermediate valve section 53 and the front valve section 51, and oil can be discharged from the second outflow passage 46 to the drain flow passage 47 (see FIG. 3D). Furthermore, in this case, the second inflow passage 45 and the second outflow passage 46 are shut off by the intermediate valve section 53, and ail inside the second hydraulic control chamber 17*b* of the oil pump A is discharged readily via the communicating path configured by the second communicating passage 93, the second outflow passage 46 and the drain flow passage 47 (see FIG. 5B). Consequently, the outer ring 3 of the oil pump A can rotate smoothly and the discharge amount can be varied smoothly (see FIG. 3D, FIG. 5B).

As the hydraulic pressure becomes higher, the force due to the hydraulic pressure gradually becomes greater than the force of the elastic member 6, and the spool valve body 5 moves to the rear side of the spool valve body passage 41. The second outflow passage 46 is closed by the intermediate valve section 53 of the spool valve body 5 and the hydraulic pressure is not transmitted to the second hydraulic control chamber 17*b* of the oil pump A.

Next, the operating valve C is used in order to control the operation of the hydraulic control valve B (see FIG. 1, FIG. 2A-2D, etc.). The operating valve C uses, specifically, a solenoid valve C1. The solenoid valve C1 has a supply oil passage 71, a first branching supply oil passage 72 and a second branching supply oil passage 73 formed inside the valve case 7. The supply oil passage 71 is communicated with the branching flow passage 91 of the oil circuit 9. The first branching supply oil passage 72 is communicated with the shared oil passage 49 of the hydraulic control valve B, and the second branching supply oil passage 73 is communicated with the valve operating oil passage 42.

The supply oil passage 71, the first branching supply oil passage 72 and the second branching supply oil passage 73 are connected via a direction control valve body 74. The direction control valve body 74 is formed with a main direction control oil passage 74*a* and a subsidiary direction control oil passage 74*b*, and the main direction control oil passage 74*a* and the subsidiary direction control oil passage 74*b* are communicated inside the direction control valve body 74. The direction control valve body 74 communicates the supply oil passage 71 and the first branching supply oil passage 72 at all times by the main direction control oil passage 74*a*.

Furthermore, the supply oil passage 71 and the second branching supply oil passage 73 are communicated by the main direction control oil passage 74*a* and the subsidiary direction control oil passage 74*b* (see FIGS. 2A, 2B), and are configured so as to be switched, as appropriate, to a shut-off state by rotating the direction control valve body 74 (see FIGS. 2C, 2D). The direction of the direction control valve body 74 is controlled by an electromagnetic operation. Therefore, the solenoid valve C1 communicates the branching flow passage 91 and the shared oil passage 49 at all times (see FIG. 2).

Furthermore, the branching flow passage 91 and the valve operating oil passage 42 are mutually communicated and shut off, as appropriate, by the direction control valve body 74 of the solenoid valve C1 (see FIGS. 2C, 2D). The solenoid valve C1 is controlled in accordance with the speed range of the engine, so as to communicate the branching flow passage 91 and the valve operating oil passage 42 in such a manner that hydraulic pressure is applied to the valve operating oil passage 42, when it is necessary to shift the spool valve body 5 inside the valve body passage 41 at low engine speed (see FIG. 4A). Furthermore, when the spool valve body 5 is to be halted in the initial position at as high an engine speed as possible, then the solenoid valve C1 is controlled so as to shut off the branching flow passage 91 and the valve operating oil passage 42 (see FIG. 5A-5B). Furthermore, although not illustrated specifically in the drawings, the operating valve C may be a hydraulic type of operating valve, rather than a solenoid valve C1.

Next, the control operation of the flow of oil in the present invention will be described on the basis of FIG. 4 and FIG. 5. Firstly, in the low engine speed range, the solenoid valve C1 communicates the branching flow passage 91 of the oil circuit 9 and the valve operating oil passage 42 of the hydraulic control valve B, and hydraulic pressure is applied to the spool valve body 5 (see FIG. 4A). However, at low engine speeds, the hydraulic pressure is low, the force of the elastic member 6 is relatively greater than the force due to the hydraulic pressure, and the spool valve body 5 is positioned on the valve operating oil passage 42 side of the valve body passage 41. In this state, the second outflow passage 46 is not closed off by the intermediate valve section of the spool valve body 5, and therefore the hydraulic pressure can be transmitted to the second hydraulic control chamber 17*b* of the oil pump A (see FIG. 4A).

In the medium engine speed range, the same operation as that of the operating valve C in the low speed range is continued, and the branching flow passage 91 of the oil circuit 9 and the valve operating oil passage 42 of the hydraulic control valve B are communicated (see FIG. 4B). In the medium speed range, as the hydraulic pressure gradually rises, the force due to the hydraulic pressure becomes gradually greater than the force of the elastic member 6, and the spool valve body 5 starts to moves to the rear side along the valve body passage 41. Moreover, the spool valve body 5 receives hydraulic pressure from the valve operating oil passage 42 and the first inflow passage 43, and moves further to the rear side along the valve body passage 41, and the intermediate valve section 53 reaches substantially the same position as the second outflow passage 46 in the axial direction (see FIG. 4B).

The second outflow passage 46 is closed off by the intermediate valve section 53 of the spool valve body 5, and the hydraulic pressure is not transmitted to the second hydraulic control chamber 17*b* of the oil pump A. In this way, the intermediate valve section 53 can completely close off the second outflow passage 46, and even if the intermediate valve section 53 moves to some extent, the second outflow passage 46 is shut and hunting can be suppressed by the damping effect of the oil (see FIG. 3C).

Even if the intermediate valve section 53 of the spool valve body 5 moves slightly past the center of the second outflow passage 46 in the axial direction, the second outflow passage 46 still remains shut due to the intermediate valve section 53, and only when the intermediate valve section 53 moves to the rear side of the valve body passage 41 do the second outflow passage 46 and the drain flow passage 47 become communicated (see FIG. 3D). Consequently, the oil inside the second hydraulic control chamber 17*b* is discharged. Furthermore, in this case, the oil can be sent continuously, little by little, into the second hydraulic control chamber 17*b* from the orifice 48, and sudden changes in the pressure inside the second hydraulic control chamber 17*b* can be prevented.

In the transition region where the engine speed increases from the medium engine speed and moves to the high engine speed, the direction control valve body 74 of the solenoid valve C1 shuts off the branching flow passage 91 and the valve operating oil passage 42, and the supply of hydraulic pressure from the valve operating oil passage 42 to the pressure receiving shaft 55 of the spool valve body 5 is stopped. Therefore, the surface area receiving pressure for pushing the spool valve body 5 to the rear side of the valve body passage 41 decreases, and the force due to the hydraulic pressure for pushing the spool valve body 5 to the rear side of the valve body passage 41 also decreases. Therefore, the force due to the elastic member 6 becomes greater and the spool valve body 5 moves to the front side. Consequently, the second outflow passage 46 is not closed by any of the valve sections of the spool valve body 5, and the hydraulic pressure can be transmitted to the second hydraulic control chamber 17*b* of the oil pump A (see FIG. 5A).

Figure 7:
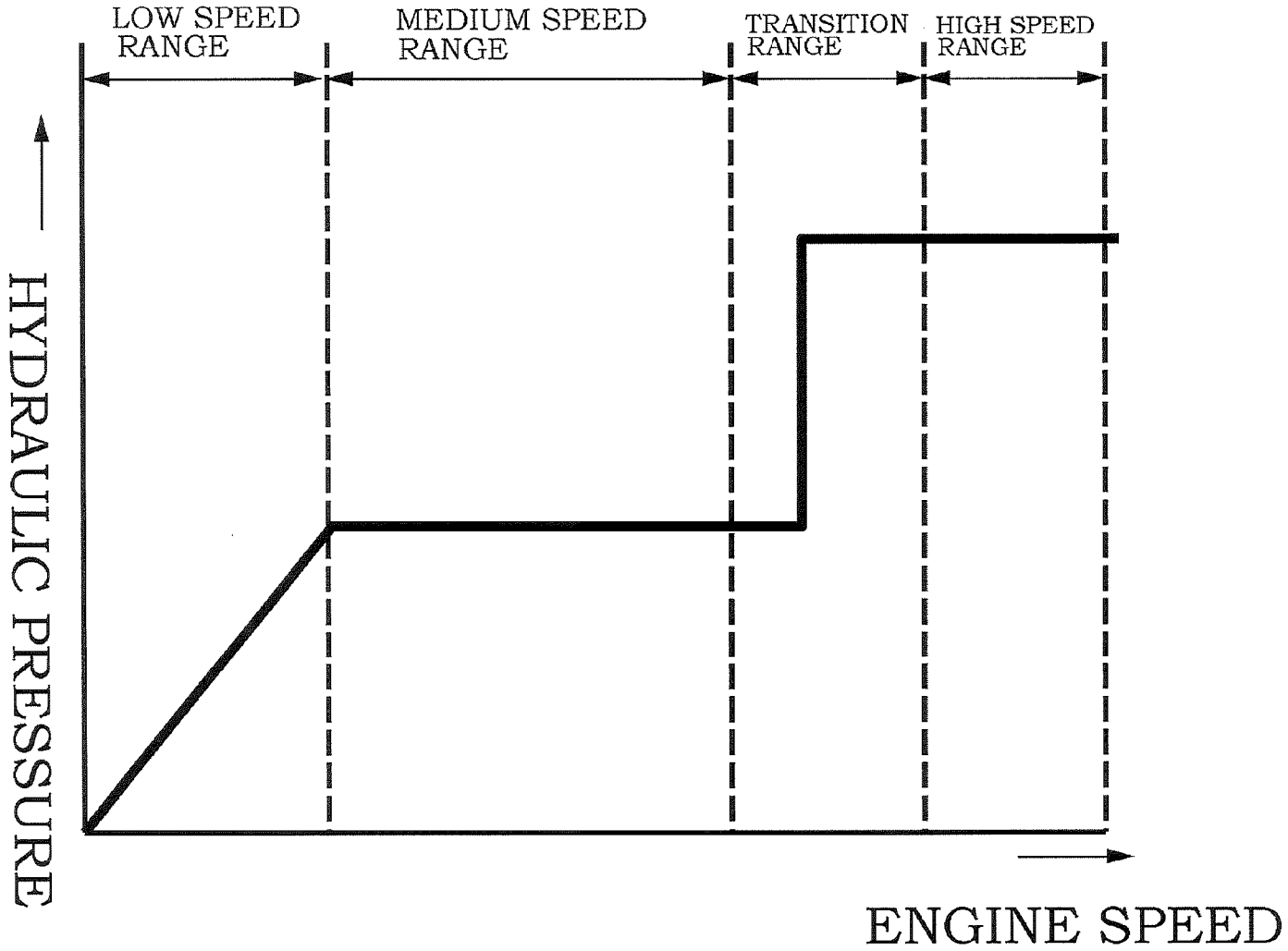
FIG. 7 is a graph showing the characteristics of the present invention.

Next, in the high speed range, the hydraulic pressure becomes even higher, and even if the surface area on which the force due to the hydraulic pressure is acting on the spool valve body 5 is small, this force is greater than the force due to the elastic member 6 and the spool valve body 5 moves to the rear side in the valve body passage 41. In this case, the second inflow passage 45 is closed off by the intermediate valve section 53 of the spool valve body 5, and the hydraulic pressure is not transmitted to the second hydraulic control chamber 17*b* of the oil pump A. In this way, even in the high speed range, the second inflow passage 45 and the second outflow passage 46 are not communicated. Furthermore, FIG. 7 shows the state of the hydraulic pressure respectively in the low speed range, medium speed range, transition range and high speed range of the engine.

Furthermore, the orifice 48 is communicated with the second hydraulic control chamber 17*b* of the oil pump A at all times, and hence a structure is achieved in which a slight hydraulic pressure is applied to the second hydraulic control chamber 17*b* of the oil pump A at all times (see FIG. 4A-4C and FIG. 5A-5B). By providing the orifice 48 in the hydraulic control valve B, a slight hydraulic pressure is applied continuously at all times to the second hydraulic control chamber 17*b* of the oil pump A, via the orifice 48, and therefore the hydraulic pressure variation in the second hydraulic control chamber 17*b* decreases in accordance with the hydraulic pressure applied via the orifice 48. Consequently, since the hydraulic pressure variation in the second hydraulic control chamber 17*b* can be reduced, then even if the discharge amount of the oil pump A (discharge performance) changes, there is no sudden variation and the occurrence of a large amplitude in the hydraulic pressure (so-called hydraulic pulsations) can be suppressed.

Figure 6:
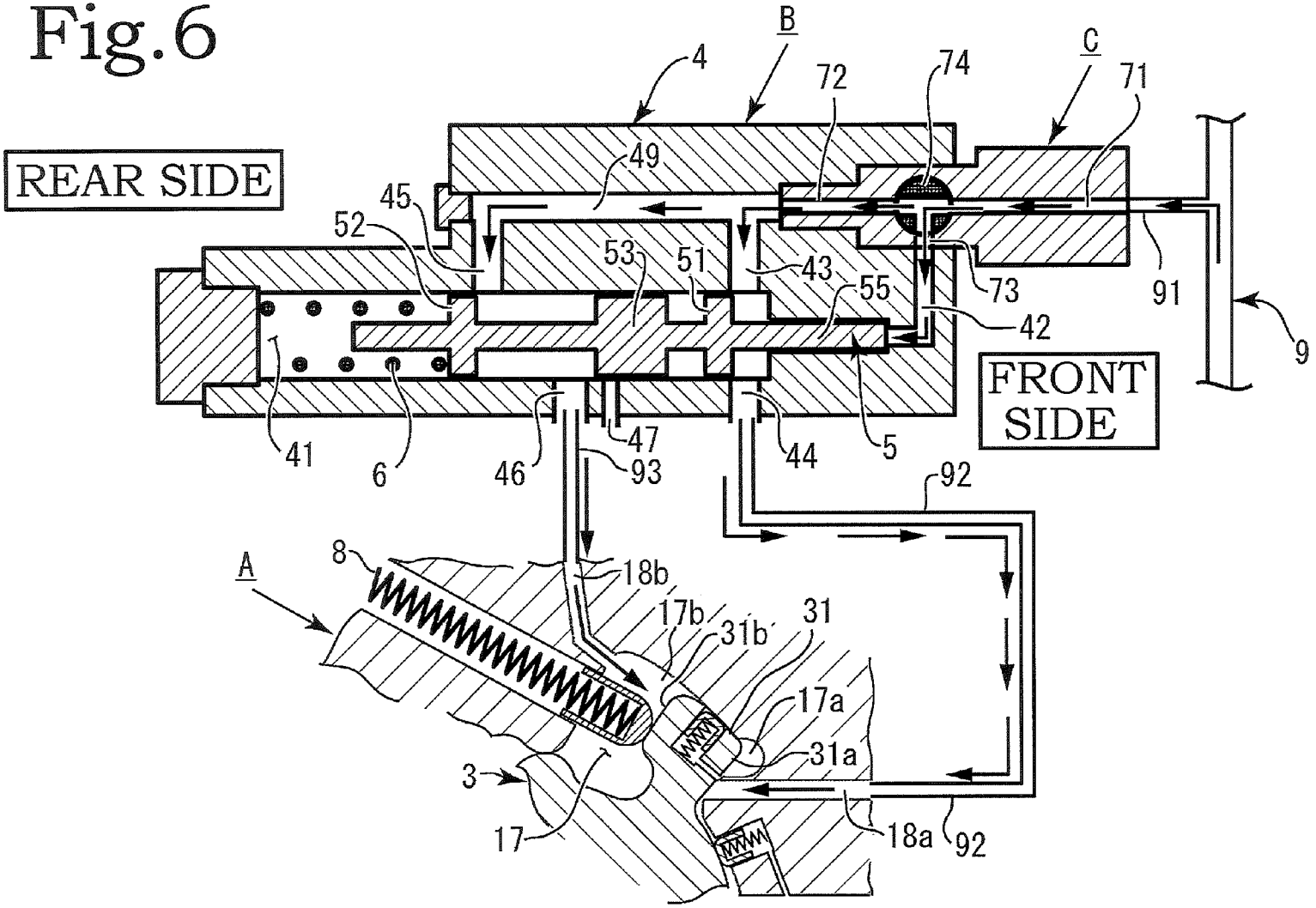
FIG. 6 is a schematic drawing of an embodiment in which an orifice is not provided in the present invention.

The hydraulic pressure of the second hydraulic control chamber 17*b* of the oil pump A is slightly higher than the atmospheric pressure in accordance with the hydraulic pressure supplied from the orifice 48. Therefore, it is possible to reduce the hydraulic pressure variation in the second hydraulic control chamber 17*b* of the oil pump A. Furthermore, it is also possible to omit the orifice 48 from the hydraulic control valve B (see FIG. 6). In this case, oil is not sent to the second hydraulic control chamber 17*b* at all times, but since oil is always sent to the first hydraulic control chamber 17*a* via the first inflow passage 43 and the first outflow passage 44, then hydraulic pressure is applied to the first hydraulic control chamber 17*a* at all times, and therefore noise and/or vibrations in the oil pump A can be suppressed.

In a second embodiment, an orifice flow passage is provided in the hydraulic control valve. Consequently, even if the hydraulic control valve is switched from a state where a control hydraulic pressure is being applied to the second hydraulic control chamber of the oil pump, and the hydraulic pressure in the second hydraulic control chamber of the oil pump is to be released into the atmosphere all at once, then since a slight hydraulic pressure is applied continuously at all times to the control chamber of the second hydraulic control chamber of the oil pump via the orifice, the hydraulic pressure variation in the second hydraulic control chamber of the oil pump decreases in accordance with the oil pressure applied via the orifice.

Even if the oil path is switched by the hydraulic control valve, since the hydraulic pressure variation in the control chamber of the second hydraulic control chamber of the oil pump can be reduced, then although the discharge capacity (discharge performance) of the oil pump changes, this change is not sudden. Furthermore, the discharge pressure of the oil pump changes, but this change is not sudden either, and the occurrence of a large amplitude in the hydraulic pressure (known as "hunting") can be suppressed. Consequently, in an oil pump which uses the spool valve of the present invention for control purposes, it is possible to suppress noise and/or vibrations.

In a third embodiment, an operating valve for switching the valve operating oil passage between a communicated and a shut-off state is provided, whereby the operation of the hydraulic control valve can be carried out even more reliably. In a fourth embodiment, by making the operating valve a solenoid valve, it is possible to operate the hydraulic control valve freely, with high accuracy.

What is claimed is:

1. An oil pump structure, comprising: an oil pump which has a first hydraulic control chamber and a second hydraulic control chamber for performing an operation of varying a discharge amount, and in which an operation for varying the capacity is performed by applying a control hydraulic pressure to the first hydraulic control chamber and the second hydraulic control chamber; a hydraulic control valve which has a valve operating oil passage, a first inflow passage and a second inflow passage, by which oil discharged from the oil pump flows in, a first outflow passage by which oil is sent to the first hydraulic control chamber, a second outflow passage by which oil is sent to the second hydraulic control chamber, and a drain flow passage by which oil can be discharged externally; and an oil circuit in which oil is circulated by the oil pump, wherein the hydraulic control valve is connected to a branching flow passage of the oil circuit; a spool valve body which slides inside the hydraulic control valve is constituted by a connecting shaft, a front valve section, a rear valve section, and an intermediate valve section positioned between the front valve section and the rear valve section, with the front valve section, the rear valve section, and the intermediate valve section being formed perpendicularly to an axial direction of the connecting shaft; an axial-direction dimension of the intermediate valve section is larger than an axial-direction dimension of the second outflow passage; the second outflow passage and the drain flow passage are both temporarily accommodated between the intermediate valve section and the front valve section due to movement of the spool valve body; and a control hydraulic pressure is applied at all times to the first hydraulic control chamber, and the control hydraulic pressure is increased or decreased in the second hydraulic control chamber, by the hydraulic control valve.

2. The oil pump structure according to claim 1, wherein an orifice which communicates at all times with the second hydraulic control chamber is provided in the hydraulic control valve.

3. The oil pump structure according to claim 1, further comprising an operating valve which switches between connection and shut-off of the valve operating oil passage.

4. The oil pump structure according to claim 3, wherein the operating valve comprises a solenoid valve.

5. The oil pump structure according to claim 2, further comprising an operating valve which switches between connection and shut-off of the valve operating oil passage.

* * * * *